US012478183B2

(12) United States Patent
Ge

(10) Patent No.: US 12,478,183 B2
(45) Date of Patent: Nov. 25, 2025

(54) TENSION BRACE FOR GOODS RACK

(71) Applicant: Qingdao Lanshan Trade Co., Ltd, Qingdao (CN)

(72) Inventor: Zhiqiang Ge, Qingdao (CN)

(73) Assignee: QINGDAO LANSHAN TRADE CO., LTD., Qingdao (CN)

( * ) Notice: Subject to any disclaimer, the term of this patent is extended or adjusted under 35 U.S.C. 154(b) by 0 days.

(21) Appl. No.: 18/790,736

(22) Filed: Jul. 31, 2024

(65) Prior Publication Data

US 2025/0344855 A1 Nov. 13, 2025

(30) Foreign Application Priority Data

May 10, 2024 (CN) ..... 202421002097.5

(51) Int. Cl.
*A47B 96/14* (2006.01)
*A47B 47/02* (2006.01)
*A47B 96/06* (2006.01)

(52) U.S. Cl.
CPC ..... *A47B 96/1441* (2013.01); *A47B 47/028* (2013.01); *A47B 96/06* (2013.01)

(58) Field of Classification Search
CPC . A47B 96/1441; A47B 96/06; A47B 47/0083; A47B 47/027; A47B 47/028
USPC ..... 211/183, 192, 191
See application file for complete search history.

(56) References Cited

U.S. PATENT DOCUMENTS

| | | | | |
|---|---|---|---|---|
| 3,378,976 | A * | 4/1968 | Meredith, Jr. | E04B 9/122 403/219 |
| 4,665,838 | A * | 5/1987 | Minshall | A47B 47/021 211/186 |
| 5,279,431 | A * | 1/1994 | Highsmith | B65G 1/02 211/187 |
| 9,215,926 | B1 * | 12/2015 | Offerman | A47B 47/02 |
| 9,215,931 | B1 * | 12/2015 | Offerman | A47B 96/024 |
| 9,290,322 | B2 * | 3/2016 | Heijmink | A47B 47/0058 |
| 9,386,855 | B2 * | 7/2016 | Sabounjian | A47B 96/14 |
| 9,661,921 | B1 * | 5/2017 | Tsai | A47B 57/50 |
| 10,299,594 | B2 * | 5/2019 | Liss | A47B 47/027 |
| 10,729,245 | B2 * | 8/2020 | Wang | A47B 47/00 |
| 10,806,257 | B1 * | 10/2020 | Liu | A47B 47/024 |
| 11,026,509 | B2 * | 6/2021 | Walker | A47B 47/0083 |

(Continued)

FOREIGN PATENT DOCUMENTS

CN 217261344 U 8/2022

*Primary Examiner* — Jennifer E. Novosad
(74) *Attorney, Agent, or Firm* — HAUPTMAN HAM, LLP

(57) ABSTRACT

A tension brace for a goods rack includes a tension brace main plate. Tension brace connection plates connected with second vertical connection plates of corresponding transverse braces are symmetrically disposed at both ends of length direction of the tension brace main plate. The tension brace connection plates are detachably connected with the corresponding second vertical connection plates respectively. A tension brace top plate pressed on a top end of a horizontal plate is disposed on a top end of the tension brace main plate. A matching gap for avoiding a combination structure of the horizontal plate and an inclined plate is respectively disposed at both ends of length direction of the tension brace main plate. In the tension brace for the goods rack in the present disclosure, the tension brace is detachably connected between the corresponding transverse braces.

6 Claims, 5 Drawing Sheets

(56) References Cited

U.S. PATENT DOCUMENTS

| | | | | |
|---|---|---|---|---|
| 11,602,221 | B1 * | 3/2023 | Beck | A47B 47/0083 |
| 11,871,844 | B2 * | 1/2024 | Yoon | A47B 47/0083 |
| 11,925,258 | B2 * | 3/2024 | Chakraborthy | A47B 96/07 |
| 12,004,646 | B2 * | 6/2024 | Straatsma | A47B 47/027 |
| 12,144,421 | B2 * | 11/2024 | Hanlon | A47B 96/021 |
| 12,161,221 | B2 * | 12/2024 | Ge | A47B 57/265 |
| 2010/0084354 | A1 * | 4/2010 | Eustace | A47F 5/00 211/183 |
| 2017/0238703 | A1 * | 8/2017 | Tsai | A47B 57/50 |

* cited by examiner

TENSION BRACE FOR GOODS RACK

RELATED APPLICATIONS

The present application claims priority from Chinese Application Number 202421002097.5, filed May 10, 2024, the disclosure of which is hereby incorporated by reference herein in its entirety.

TECHNICAL FIELD

The present disclosure relates to the field of goods rack technologies and in particular to a tension brace for a goods rack.

BACKGROUND

Goods racks are usually used to store goods in a workshop or warehouse. In order to solve the problems of difficult handling and large occupation space during transportation of goods racks, the existing goods racks are usually designed as a detachable structure.

The existing detachable goods racks usually include four column assemblies respectively located at four corners of a rectangle. A plurality of support frames on each of which a goods placement board is disposed are disposed among the four column assemblies along a height direction. Each of the support frames includes four transverse braces forming a rectangular frame structure. At present, a common transverse brace is of ZJ type structure. As shown in FIG. 1, the transverse brace includes a first vertical connection plate 01, a horizontal plate 02, an inclined plate 03 and a second vertical connection plate 04 sequentially and fixedly connected from top down. An upper surface of the horizontal plate 02 is used as a support platform for supporting a goods placement board. A bottom end of the first vertical connection plate 01 is fixedly connected with one end of the horizontal plate 02, and the other end of the horizontal plate 02 is fixedly connected with a top end of the inclined plate 03. A bottom end of the inclined plate 03 is fixedly connected with a top end of the second vertical connection plate 04. Both ends of length direction of the first vertical connection plate 01 and the second vertical connection plate 04 are respectively provided with a connection hole for connecting with the corresponding column assembly. In order to ensure the stability of the mounted goods racks, one tension brace is usually disposed perpendicular to two longer of the transverse braces forming the rectangular frame structure.

The existing tension brace is of flat plate structure, and both ends of the tension brace is connected in a downward insertion way with the inclined plates 03 of the corresponding transverse braces. The existing tension brace structure tends to bend downward under heavy load, thereby affecting the entire stability of the goods rack.

SUMMARY

In order to solve the above shortcomings of the prior arts, the present disclosure provides a tension brace for a goods rack.

In order to achieve the above purpose, the present disclosure employs the following technical solution.

There is provided a tension brace for a goods rack, which includes a tension brace main plate. Tension brace connection plates connected with second vertical connection plates of corresponding transverse braces are symmetrically disposed at both ends of length direction of the tension brace main plate.

The tension brace connection plates are detachably connected with the corresponding second vertical connection plates respectively.

A tension brace top plate pressed on a top end of a horizontal plate is disposed on a top end of the tension brace main plate.

A matching gap for avoiding a combination structure of the horizontal plate and an inclined plate is respectively disposed at both ends of length direction of the tension brace main plate.

Preferably, the tension brace top plate and the tension brace connection plates are fixedly connected perpendicular to each other.

Preferably, a tension brace bottom plate is fixedly and perpendicularly connected at a bottom end of the tension brace main plate, and the corresponding tension brace connection plates are fixedly and perpendicularly connected at both ends of length direction of the tension brace bottom plate.

Preferably, the tension brace main plate, the tension brace top plate and the tension brace bottom plate together form a U-shaped structure with an opening facing aside.

Preferably, a tension brace rivet is disposed respectively in a middle part of the second vertical connection plates of the transverse braces cooperating with the tension brace.

Tension brace hanging holes connected with the tension brace rivets are disposed on the tension brace connection plates 12 respectively.

Each of the tension brace hanging holes includes a straight hole segment and an arc hole segment connected with each other. An end of the straight hole segment away from the arc hole segment is disposed as an opening. A width of vertical direction of the straight hole segment is gradually reduced from the opening end to the end of the straight hole segment connecting with the arc hole segment. A width of vertical direction of the end of the straight hole segment connecting with the arc hole segment is less than a diameter of the arc hole segment.

Preferably, a first tension brace connection hole is disposed respectively in a middle part of the second vertical connection plates of the transverse braces cooperating with the tension brace.

Second tension brace connection holes corresponding to the first tension brace connection holes are disposed respectively on the tension brace connection plates, and the first tension brace connection holes and the second tension brace connection holes are round through holes.

A tension brace explosion fastener is respectively disposed in the corresponding first tension brace connection holes and second tension brace connection holes.

In the tension brace for the goods rack in the present disclosure, since the tension brace main plate is disposed further at a bottom end of the tension brace top plate achieving the supporting effect, the tension brace of the present disclosure has better bearing capacity than the existing tension braces of flat plate structure. In the present disclosure, the tension brace is detachably connected between the corresponding transverse braces. When the tension brace is mounted, the tension brace top plate can be pressed on the horizontal plates of the corresponding transverse braces to prevent the rotation of the tension brace, ensuring the entire stability of the mounted goods rack.

BRIEF DESCRIPTIONS OF THE DRAWINGS

The drawings of the specification forming a part of the present disclosure are used to provide further understanding for the present disclosure. The illustrative embodiments and their descriptions in the present disclosure are used to interpret the present disclosure and do not constitute any improper limitation to the present disclosure.

Figure 1:
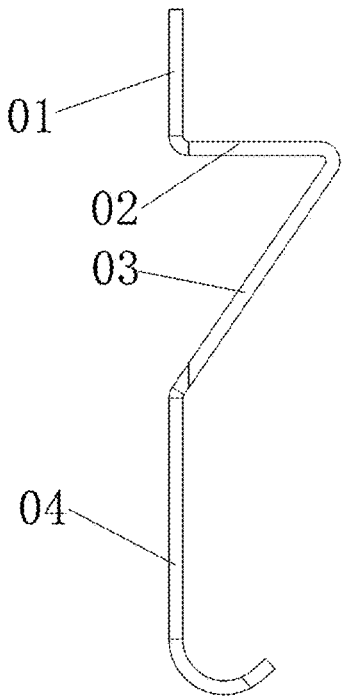
Prior Art Fig.1
FIG. 1 is a structural schematic diagram of a transverse brace in the prior arts.

Numerals of the drawings are described below:

01. first vertical connection plate, 02. horizontal plate, 03. inclined plate, 04. second vertical connection plate;

11. tension brace main plate, 12. tension brace connection plate, 13. tension brace top plate, 14. matching gap, 15. tension brace bottom plate, 16. tension brace rivet, 17. tension brace hanging hole, 171. straight hole segment, 172. arc hole segment, 18. first tension brace connection hole, 19. second tension brace connection hole, and 110. tension brace explosion fastener.

DETAILED DESCRIPTIONS OF EMBODIMENTS

It should be noted that the following detailed descriptions are only illustrative and aim to provide further understanding for the present disclosure. Unless otherwise stated clearly, all technological and scientific terms used in the present disclosure have the same meaning as persons of ordinary skill in the prior arts generally understand.

The present disclosure is further described below in combination with drawings and embodiments.

Embodiment 1

There is provided a tension brace for a goods rack, which includes a tension brace main plate 11. Tension brace connection plates 12 connected with second vertical connection plates 04 of corresponding transverse braces are symmetrically disposed at both ends of length direction of the tension brace main plate 11.

The tension brace connection plates 12 are detachably connected with the corresponding second vertical connection plates 04 respectively.

A tension brace top plate 13 pressed on a top end of a horizontal plate 02 is disposed on a top end of the tension brace main plate 11. In the present disclosure, since the tension brace main plate 11 is further disposed at a bottom end of the tension brace top plate 13 achieving supporting effect, the tension brace in the present disclosure has better bearing capacity than the existing the tension braces with flat plate structure.

A matching gap 14 for avoiding the combination structure of the horizontal plate 02 and an inclined plate 03 is respectively disposed at both ends of length direction of the tension brace main plate 11.

Preferably, the tension brace top plate 13 and the tension brace connection plates 12 are fixedly connected perpendicular to each other.

Preferably, a tension brace bottom plate 15 is fixedly and perpendicularly connected at a bottom end of the tension brace main plate 11, and the corresponding tension brace connection plates 12 are fixedly and perpendicularly connected at both ends of length direction of the tension brace bottom plate 15.

Preferably, the tension brace main plate 11, the tension brace top plate 13 and the tension brace bottom plate 15 together form a U-shaped structure with an opening facing aside. In the present disclosure, compared with the existing tension braces with flat plate structure, the U-shaped tension brace body structure has a higher bearing capacity.

Embodiment 2

Figure 4:
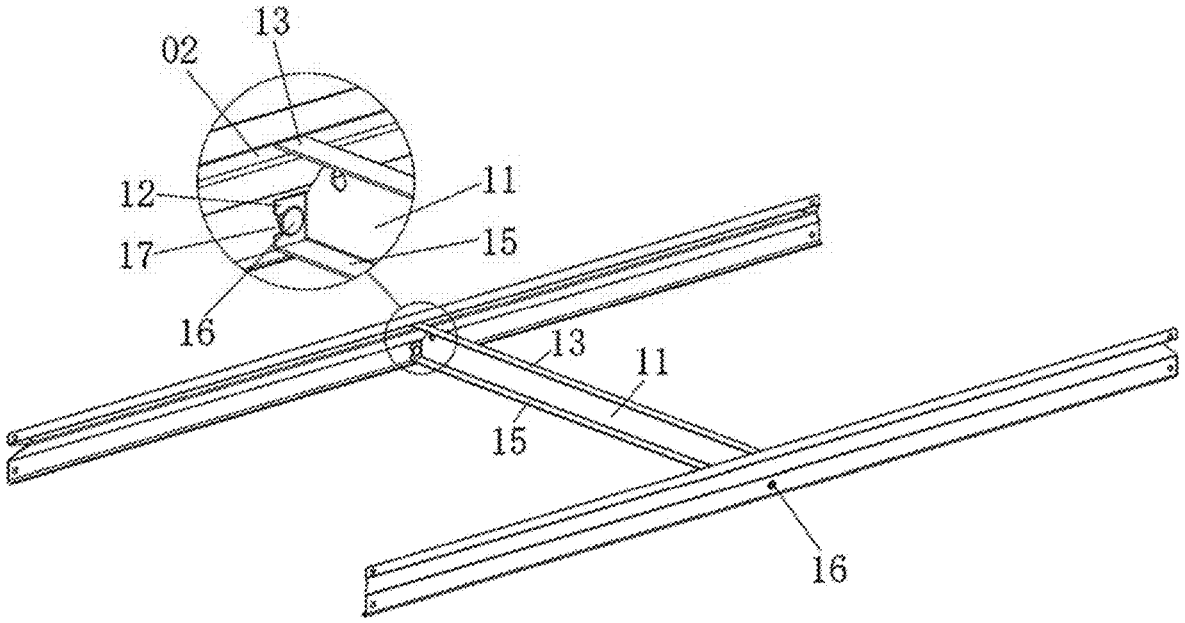
FIG. 4 is a schematic stereoscopic diagram illustrating cooperation of a tension brace and a transverse brace for a goods rack according an embodiment 2 of the present disclosure.
Figure 5:
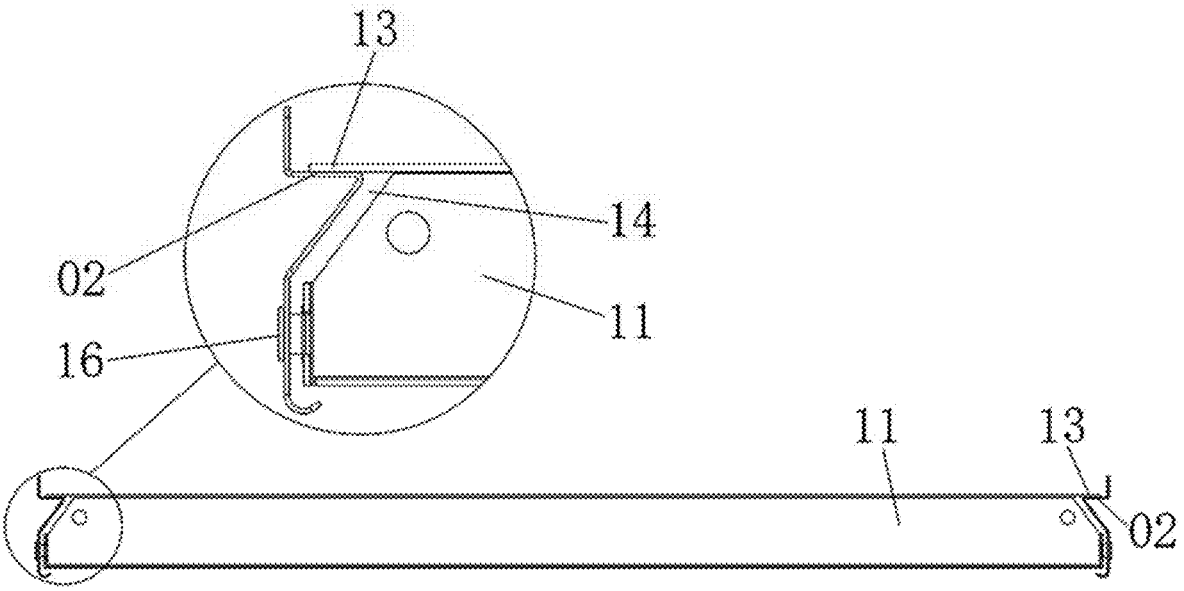
FIG. 5 is a schematic side view illustrating cooperation of a tension brace and a transverse brace for a goods rack according an embodiment 2 of the present disclosure.

On the basis of the embodiment 1, as shown in FIGS. 4 to 5, a tension brace rivet 16 is disposed respectively in a middle part of the second vertical connection plates 04 of the transverse braces cooperating with the tension brace.

Figure 2:
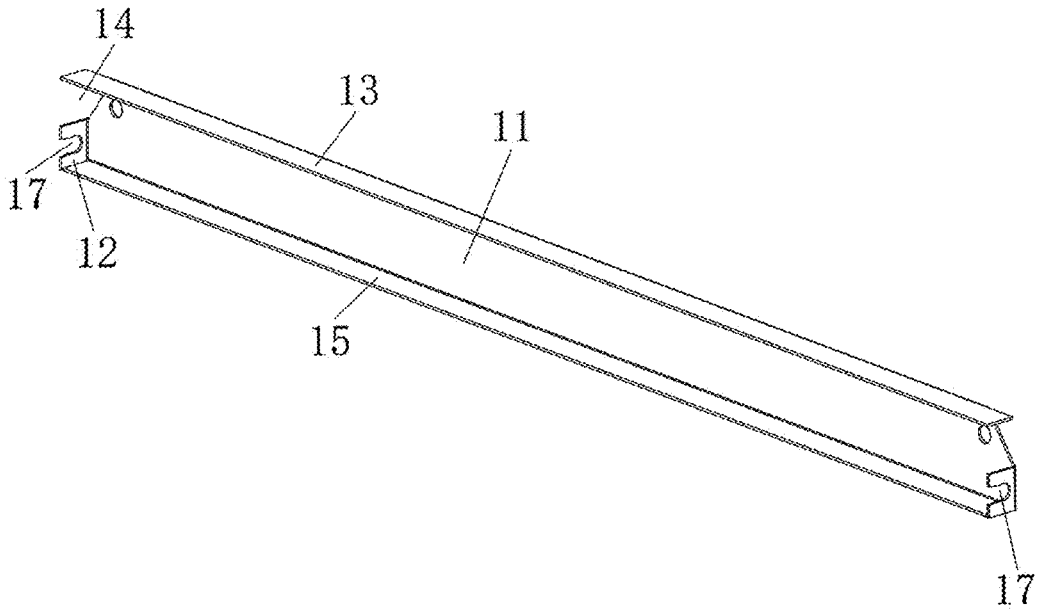
FIG. 2 is a structural stereoscopic diagram illustrating a tension brace for a goods rack according an embodiment 2 of the present disclosure.
Figure 3:
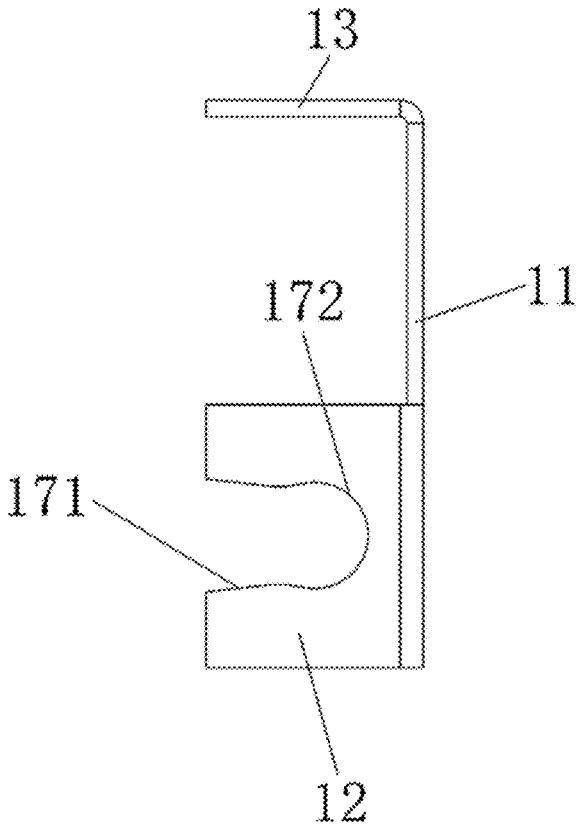
FIG. 3 is a structural front view illustrating a tension brace for a goods rack according an embodiment 2 of the present disclosure.

As shown in FIGS. 2 to 3, tension brace hanging holes 17 connected with the tension brace rivets 16 are disposed on the tension brace connection plates 12 respectively.

Each of the tension brace hanging holes 17 includes a straight hole segment and an arc hole segment connected with each other. An end of the straight hole segment 171 away from the arc hole segment 172 is disposed as an opening, namely, the end of the straight hole segment 171 away from the arc hole segment 172 extends to an end surface of the corresponding tension brace connection plate 12. A width of vertical direction of the straight hole segment 171 is gradually reduced from the opening end to the end of the straight hole segment 171 connecting with the arc hole segment 172. A width of vertical direction of the end of the straight hole segment 171 connecting with the arc hole segment 172 is less than a diameter of the arc hole segment 172.

In the embodiment 2, the tension brace top plate 13 is pressed on the horizontal plate 02, and then the tension brace is slid into between two transverse braces from right to left and then to the positions of the two tension brace rivets 16, and at this time, the tension brace hanging holes 17 are fitted to the corresponding tension brace rivets 16 from right to left, so as to achieve the mounting of the tension brace. Further, the disposal of the tension brace top plate 13 can prevent the rotation of the tension brace so as to ensure the entire stability of the mounted goods rack.

Embodiment 3

Figure 8:
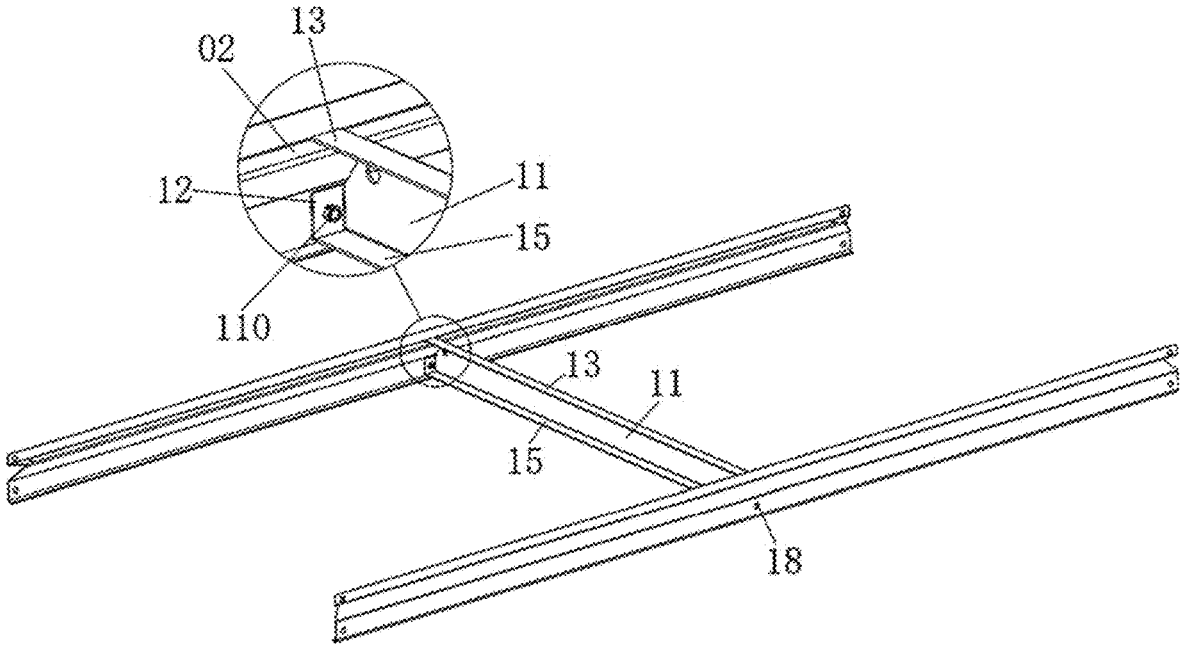
FIG. 8 is a schematic stereoscopic diagram illustrating cooperation of a tension brace and a transverse brace for a goods rack according an embodiment 3 of the present disclosure.
Figure 9:
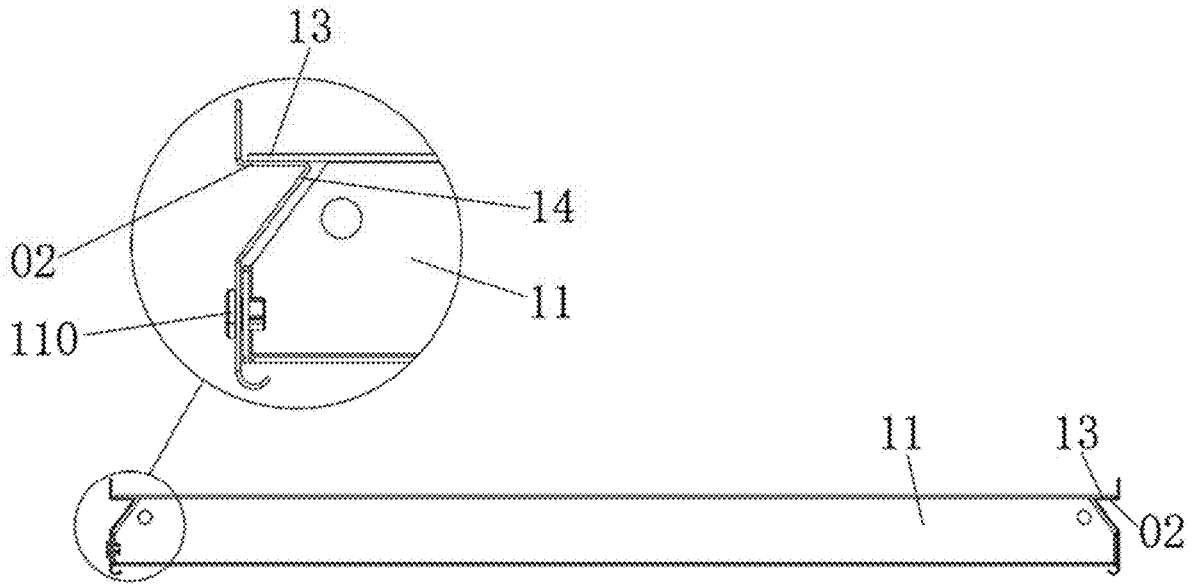
FIG. 9 is a schematic side view illustrating cooperation of a tension brace and a transverse brace for a goods rack according an embodiment 3 of the present disclosure.

On the basis of the embodiment, 1, as shown in FIGS. 8 to 9, a first tension brace connection hole 18 is disposed respectively in a middle part of the second vertical connection plates 04 of the transverse braces cooperating with the tension brace.

Figure 6:
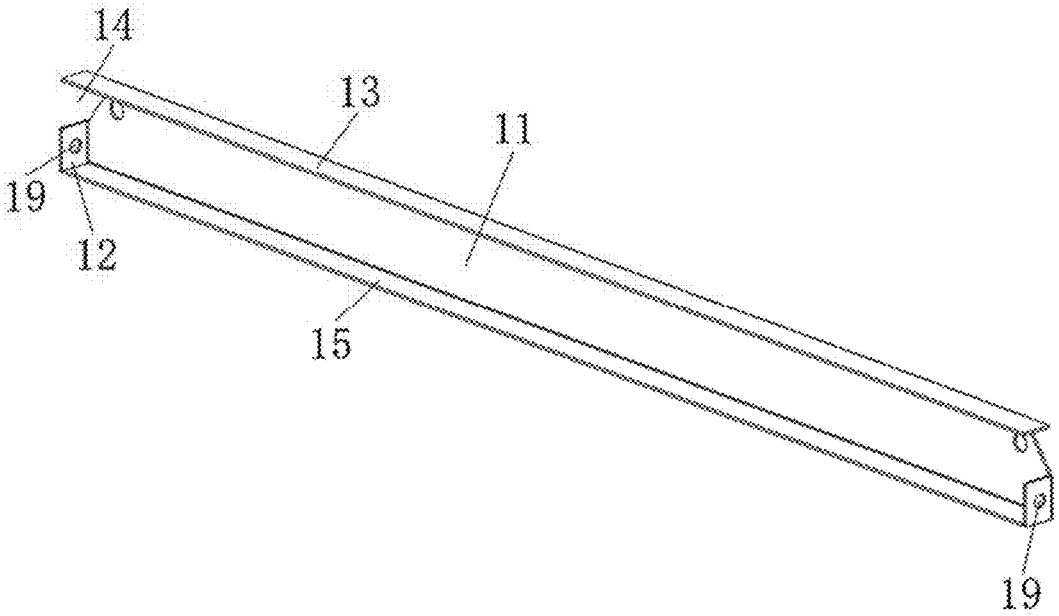
FIG. 6 is a structural schematic stereoscopic diagram illustrating a tension brace for a goods rack according an embodiment 3 of the present disclosure.
Figure 7:
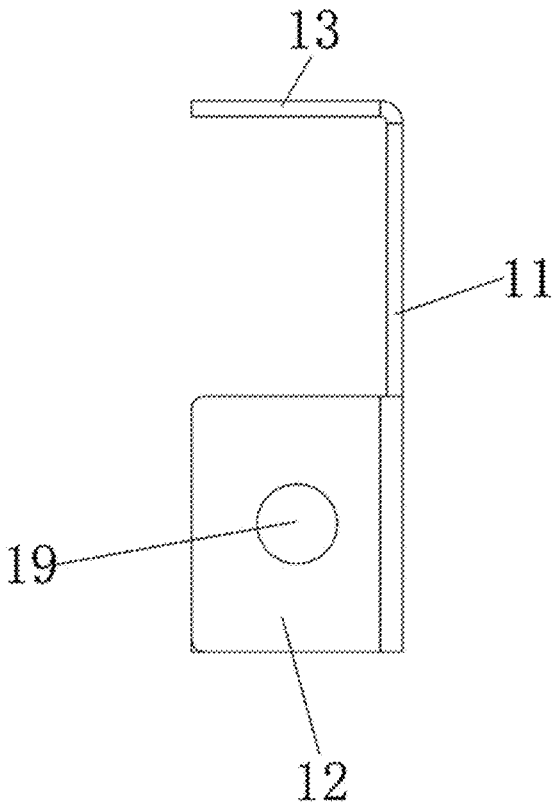
FIG. 7 is a structural schematic front view illustrating a tension brace for a goods rack according an embodiment 3 of the present disclosure.

As shown in FIGS. 6 to 7, second tension brace connection holes 19 corresponding to the first tension brace connection holes 18 are disposed respectively on the tension brace connection plates 12, and the first tension brace connection holes 18 and the second tension brace connection holes 19 are round through holes.

A tension brace explosion fastener 110 is respectively disposed in the corresponding first tension brace connection holes 18 and second tension brace connection holes 19.

In the embodiment 3, the tension brace top plate 13 is pressed on the horizontal plate 02, and then the tension brace is slide into between two transverse braces from right to left; when the corresponding first tension brace connection holes 18 and second tension brace connection holes 19 are aligned with each other, the tension brace explosion fasteners 110 are mounted respectively so as to achieve the mounting of the tension brace.

In the tension brace for the goods rack in the present disclosure, the tension brace is detachably connected between the corresponding transverse braces. When the tension brace is mounted, the tension brace top plate 13 can be pressed on the horizontal plates 02 of the corresponding transverse braces to prevent the rotation of the tension brace, ensuring the entire stability of the mounted goods rack.

Although the specific embodiments of the present disclosure have been described above in combination with the drawings, the embodiments are not intended to limit the present disclosure. Those skilled in the arts should understand that various changes or variations made on the basis of the technical solutions of the present disclosure without carrying out creative work still fall within the scope of protection of the present disclosure.

The invention claimed is:

1. An apparatus for a goods rack, comprising:

a tension brace, wherein both ends along a length direction of the tension brace are respectively connected with corresponding transverse braces; and each of the transverse braces comprising a first vertical connection plate, a horizontal plate, an inclined plate, and a second vertical connection plate sequentially fixedly connected from top down, wherein a bottom end of the first vertical connection plate is fixedly connected with one end of the horizontal plate, the other end of the horizontal plate is fixedly connected with a top end of the inclined plate, and a bottom end of the inclined plate is fixedly connected with a top end of the second vertical connection plate;

wherein the tension brace comprises:

a tension brace main plate, tension brace connection plates disposed symmetrically at both ends along the length direction of the tension brace main plate, the tension brace connection plates being detachably connected with the corresponding second vertical connection plates of the transverse braces respectively;

a tension brace top plate disposed on a top end of the tension brace main plate and pressed against a top end of the horizontal plate; and matching gaps disposed at both ends along the length direction of the tension brace main plate, each matching gap being configured to avoid interference with a combination structure comprising the horizontal plate and an inclined plate.

2. The apparatus of claim 1, wherein the tension brace top plate and the tension brace connection plates are fixedly connected perpendicular to each other.

3. The apparatus of claim 2, wherein a tension brace bottom plate is fixedly and perpendicularly connected at a bottom end of the tension brace main plate, and the corresponding tension brace connection plates are fixedly and perpendicularly connected at both ends of the length direction of the tension brace bottom plate.

4. The apparatus of claim 3, wherein the tension brace main plate, the tension brace top plate and the tension brace bottom plate together form a U-shaped structure with an opening facing aside.

5. The apparatus of claim 1, wherein a tension brace rivet is disposed respectively in a middle part of the second vertical connection plates of the transverse braces cooperating with the tension brace;

tension brace hanging holes connected with the tension brace rivets are disposed on the tension brace connection plates respectively; and each of the tension brace hanging holes comprises a straight hole segment and an arc hole segment connected with each other, an end of the straight hole segment away from the arc hole segment is disposed as an opening, a width of vertical direction of the straight hole segment is gradually reduced from the opening end to an end of the straight hole segment connecting with the arc hole segment, and a width of vertical direction of the end of the straight hole segment connecting with the arc hole segment is less than a diameter of the arc hole segment.

6. The apparatus of claim 1, wherein a first tension brace connection hole is disposed respectively in a middle part of the second vertical connection plates of the transverse braces cooperating with the tension brace;

second tension brace connection holes corresponding to the first tension brace connection holes are disposed respectively on the tension brace connection plates, and the first tension brace connection holes and the second tension brace connection holes are all round through holes; and a tension brace explosion fastener is respectively disposed in the corresponding first tension brace connection holes and second tension brace connection holes.

* * * * *